US012521591B2

(12) United States Patent
Mehtälä

(10) Patent No.: US 12,521,591 B2
(45) Date of Patent: Jan. 13, 2026

(54) EXERCISING DEVICE FOR DEVELOPING, STRENGTHENING AND/OR REHABILITATING THE MUSCLES OR JOINTS OF THE BODY

(71) Applicant: MAIAK TECHNOLOGIES S.L., Alicante (ES)

(72) Inventor: Andreas Efrain Ilmari Mehtälä, Alicante (ES)

(73) Assignee: Freak Athlete Essentials LLC, Casper, WY (US)

( * ) Notice: Subject to any disclaimer, the term of this patent is extended or adjusted under 35 U.S.C. 154(b) by 0 days.

(21) Appl. No.: 18/851,257

(22) PCT Filed: Mar. 30, 2023

(86) PCT No.: PCT/EP2023/058410

§ 371 (c)(1),
(2) Date: Sep. 26, 2024

(87) PCT Pub. No.: WO2023/187124

PCT Pub. Date: Oct. 5, 2023

(65) Prior Publication Data

US 2025/0161735 A1 May 22, 2025

(30) Foreign Application Priority Data

Mar. 31, 2022 (EP) ..... 22382314

(51) Int. Cl.
*A63B 21/005* (2006.01)
*A63B 21/00* (2006.01)
(Continued)

(52) U.S. Cl.
CPC ..... *A63B 21/0058* (2013.01); *A63B 21/153* (2013.01); *A63B 24/0087* (2013.01); *A63B 71/0622* (2013.01); *A63B 2071/0675* (2013.01)

(58) Field of Classification Search
CPC ..... A63B 71/0622; A63B 21/153; A63B 21/0058; A63B 21/151; A63B 21/155;
(Continued)

(56) References Cited

U.S. PATENT DOCUMENTS 10,143,880 B1 * 12/2018 Boatwright ..... A63B 21/078
2012/0053014 A1 3/2012 Zhu
(Continued)

FOREIGN PATENT DOCUMENTS

CN 209320683 U * 8/2019
DE 20 2021 106083 11/2021
(Continued)

OTHER PUBLICATIONS

International Search Report issued in PCT/EP2023/058410, mailed Jun. 26, 2023. (2 pages).
(Continued)

*Primary Examiner* — Megan Anderson
*Assistant Examiner* — Jonathan A Dicuia
(74) *Attorney, Agent, or Firm* — Aurora Consulting LLC; Albert Du; Ashley Sloat

(57) ABSTRACT

The present invention relates to an exercising device for developing, strengthening and/or rehabilitating the muscles or joints of the body by working against a counterforce. More particularly, this invention relates to a portable electric resistance exercise device capable of performing multiple exercises for strength and endurance training.

20 Claims, 7 Drawing Sheets

(51) Int. Cl.
*A63B 24/00* (2006.01)
*A63B 71/06* (2006.01)

(58) Field of Classification Search
CPC ..... A63B 21/15; A63B 24/0087; A63B 2071/0675
See application file for complete search history.

(56) References Cited

U.S. PATENT DOCUMENTS

| | | | | |
|---|---|---|---|---|
| 2019/0099637 | A1 | 4/2019 | Valente et al. | |
| 2019/0344123 | A1* | 11/2019 | Rubin | A63B 21/0058 |
| 2021/0402249 | A1* | 12/2021 | Tipple | A63B 71/0619 |
| 2022/0184452 | A1* | 6/2022 | Valente | A63B 21/0058 |

FOREIGN PATENT DOCUMENTS

| | | | | |
|---|---|---|---|---|
| DE | 102021104709 | A1 * | 9/2022 | |
| WO | WO-2022179787 | A1 * | 9/2022 | A63B 24/0087 |

OTHER PUBLICATIONS

Extended European Search Report dated Sep. 23, 2022, in EP 22382314, 5 pages.
International Written Opinion mailed Jun. 26, 2023, in PCT/EP2023/058410, 4 pages.

* cited by examiner

EXERCISING DEVICE FOR DEVELOPING, STRENGTHENING AND/OR REHABILITATING THE MUSCLES OR JOINTS OF THE BODY

CROSS-REFERENCE TO RELATED PATENT APPLICATIONS

This is a U.S. National Phase Application under 35 U.S.C. § 371 of International Patent Application No. PCT/EP2023/058410, filed Mar. 30, 2023, and claims priority to European Patent Application No. 22382314.7, filed Mar. 31, 2022, which is incorporated by reference in its entirety. The International Application was published on Oct. 5, 2023, as International Publication No. 2023/187124 A1.

FIELD OF THE INVENTION

The present invention relates to exercising devices for developing, strengthening and/or rehabilitating the muscles or joints of the body by working against a counterforce. More particularly, this invention relates to a portable electric resistance exercise device capable of performing multiple exercises for strength and endurance training.

BACKGROUND OF THE INVENTION

Traditional mechanically operated exercising devices for developing, strengthening and/or rehabilitating the muscles or joints of the body by working against a counterforce are well-known in the art. However, most mechanically operated exercise machines or exercising devices are designed to perform only a limited number of exercises thereon, focusing on a particular group of muscles. Furthermore, traditional mechanically operated exercising devices cannot be controlled and/or programmed by a external or internal user interface.

Recently, electrically operated exercising devices have been developed, which have relevant advantages over purely mechanical machines or devices of ease of setup, precise control and detailed monitoring of performance.

The present invention uses these advances to produce a portable exercise device which is compact and lightweight, so that the device could be attached by the user for coupling different types of accessories to the exercise device. It is also powerful and versatile for providing multiple exercises for strength and endurance training.

It is, therefore, the goal of the present invention to provide an exercising device for developing, strengthening, endurance training and/or rehabilitating the muscles or joints of the body by working against a counterforce, able to be compact, powerful, providing multiple exercises wherein the resistance experienced by the user could be easily adjusted while performing the exercises.

SUMMARY OF THE INVENTION

The object of the present invention is to provide an exercising device for developing, strengthening and/or rehabilitating the muscles or joints of the body by working against a counterforce, which solves the aforementioned drawbacks and gives the advantages described below.

For this first purpose, the present invention concerns an exercising device for developing, strengthening and/or rehabilitating the muscles or joints of the body by working against a counterforce, wherein the exercising device comprises, at least:

an outer enclosure, transmission means, being configured for being rotated by an electric motor and for transmitting this rotation to a rotating body, so as to link the electric motor to the rotating body, a rotating body, being connected to the transmission means and wherein the rotating body is configured for being turned to retract a rope, cord, webbing or cable, an electric motor, being connected to the transmission means and wherein the electric motor is configured for driving and/or retarding the rotation of the transmission means according to a specific parameter or parameters sent by a control unit, a control unit, being connected to the electric motor, wherein the control unit is configured for at least commanding the electric motor rotation during the exercise of a specific motion on the basis of at least an input value selected by a user through a user interface, a rope, cord, webbing or cable, being directly or indirectly attached at one end to the rotating body, and wound around an exterior surface of the rotating body and the opposed end of the rope, cord, webbing or cable is configured for being pulled by the user to exert a desired force, and a user interface, for selecting at least a specific input value of the exercise and wherein the user interface is connected to the control unit and means for supplying electrical current to the electric motor.

The present invention is a portable exercising device capable of performing multiple exercises for strength, rehabilitation and endurance training. It is an exercise device for attachment to an external fixed point and being gripped by the user at a distal end of the rope, cord, webbing or cable to perform, for example, arm exercises.

One of the main advantages of the invention is that it can be used not only for training and to build strength or endurance but is also versatile and can be used for rehabilitation or other evaluation purposes.

The present invention is user-friendly as it can be controlled with a tactile interface or with an external device for example a smart phone, computer or a similar device, so that the resistance experienced by the user is easily adjusted while performing the exercises.

Furthermore, the present invention has the advantage to vary the force used for training or rehabilitation for example between 1 to 150 kg (not limited to 150 kg as the maximum force), this power is achieved and controlled by a combination of the transmission, motor and input interface as well as by means of the control unit.

This construction allows the user to adjust the weight or the desired resistance depending on the necessities and the type of training or recovery that is wanted to be performed, which makes the invention very versatile.

The invention is environment friendly as it is a lightweight device with small components reducing the environmental impact of shipping compared to traditional exercising equipment. It is also easy to assemble, thus, the manufacture of this invention will not use much of our resources compared to the benefit it will provide to the general well-being. Therefore, the present invention is relatively simple to manufacture and use.

Other advantage of the device is that it is easy to attach to existing equipment or other attachments as it is lightweight and compact, so it can be moved without much effort according to the user's preferences to many types of exercise equipment or other supports necessary for the use of the device.

Other advantage of the device is that it can be safely used as the design is user friendly avoiding the risk of squeezing or cutting of fingers or other body parts.

The outer enclosure is for containing the totality or part of the following elements: at least the transmissions means and/or the rotating body and/or the electric motor.

Another advantage of the invention is that it operates at a low voltage, preferably less than 50V and thus minimizes the risk of dangerous electric shocks.

The term "rope, cord, webbing or cable" has to be understood broadly as a rope, cord, webbing or cable or any other type of material that fulfils the same or similar function. The rope, cord, webbing or cable is made of a material with a high tensile strength. Preferably, a synthetic fibre having a high tensile strength or any other plastic or metal with a good sheer strength and durability properties is selected. A possible synthetic fibre is a gel-spun, multi-filament fibre that is created from polyethylene, such as UHMWPE. Preferably, the rope, cord, webbing or cable has a fully extended length of approximately, but not limited to, 2 meters.

In reference to the means for supplying electrical current to the electric motor, in a first embodiment, they may comprise a current intake for connecting a power cable to the exercising device, in such a manner that the electrical current reaches the electric motor. In a second embodiment, instead of a current intake, the means for supplying electrical current to the electric motor may comprise a battery or rechargeable battery packs, preferably integrated within the outer enclosure of the exercising device of the invention.

Optionally, the exercising device may further include a power cable connected at one end to the current intake and the opposed end ending with an external power transformer outlet. Thus, the exercising device can be connected by means of a power cable to an external current transformer. A conventional current transformer is then connected to a power socket. According to the type of alternating current (AC) of the country to be used, a specific current transformer is provided which is adapted to the specific type of alternating current (AC). For example, while in Europe and Asia the voltages are between 220 and 240V, in North America the voltage is between 100 and 125V. Due to the provision of a specific current transformer, the exercising apparatus can perfectly work for a wide range of voltage and frequency ranges, such as 110-220 V and 50-60 Hz.

In reference to the transmission means of the device, it may consist of one or more of the following components: gears, pulleys, belts and/or any other components that multiplies force. Preferably, the transmission means comprises gears and more specifically a gear set configuration that multiplies the power output from the motor to the rotating body.

In reference to the outer enclosure, it may be preferably configured by an outer wall that defines an internal space therein for containing at least the transmission means, the rotating body and the electric motor. More preferably, it may be configured for containing all the moving parts of the exercising device within it.

It is preferable that the outer enclosure is made out of a rigid element for supporting the tension of the rope, cord, webbing or cable. As a possible example, the outer enclosure is made of a polymeric or metallic material such as Aluminium, among other possible materials having the necessary properties to fulfil the required functions.

Advantageously, the shape, the reduced dimensions and the light materials of the outer enclosure permit having a compact configuration of the device for being easily moved by the user from one to another fixed training equipment or support, so that it can be used on several different training equipment or supports.

Preferably, it may comprise a protective cover with an opening, path or aperture for the output of the opposed end of the rope, cord, webbing or cable that comes out from the interior of the protective cover through said opening, path or aperture. The protective cover is configured for slightly rotating while the exercise is being executed, thus facilitating the exit of the rope, cord, webbing or cable so that it always comes out straight.

As a preferred embodiment, the outer enclosure comprises a body with a general cylindrical configuration. However, other functional shapes different from a substantially cylindrical configuration may also be used. The preferred cylindrical body of the outer enclosure can be, as an example, approximately between 80 and 100 mm thick and having a diameter between 120 and 140 mm.

The opening, path or aperture for the output of the rope, cord, webbing or cable in cooperation with the protective cover that moves while the exercise is being executed facilitates the exit of the rope, cord, webbing or cable so that it always comes out straight off the rotating body without any bends. The opening, path or aperture for the output of the rope, cord, webbing or cable of the protective cover may have the necessary configuration and size to perform this function.

In a preferred embodiment of the outer enclosure, it may be made up of three different parts, two outer covers (front and back covers), and optionally a central protective cover. These three different parts are configured for being mounted together to have an enclosed exercising apparatus. The front and back covers are fastened to the rotating body and the electric motor, and the transmission means get mounted inside the rotating body. On the other hand, the central protective cover is held in a free way as to facilitate its movement when the rope, cord, webbing or cable comes out of the hole when the exercise is being done.

Preferably, the exercising device may further comprise one or more snap rings disposed between each outer covers and the rotating body. The main function of the one or more snap rings is to make the locking of the respective outer cover with the rotating body to avoid the use of other fastening elements such as screws.

In reference to the electric motor, its function is to produce linear or rotary force (torque) intended to propel the transmission means. The electric motor is preferably disposed in a central position of the exercising apparatus and the electric motor is coaxially aligned with the rotating body. The electric motor includes a transverse outlet motor shaft which is attached to the electric motor, so that the motor shaft is used for attaching the electric motor in a determined central position within the outer enclosure.

Possible embodiments of the electric motor may be a BLDC (Brushless DC) motor, stepper motor, AC motor, or similar type.

According to one exemplary embodiment of the electric motor, the electric motor basically comprises the rotor, which moves, and the stator, which does not. The stator is fixed to the motor shaft by means of snap rings or with other elements. The stator's rotation is prevented with a shaft key or any other element that fulfils the same function. The transmission means inlet is directly connected to the electric motor, so that the linear or rotary force (torque) is transmitted to the transmission means. Preferably the stator, motor shaft, rotor, and the rotating body are all mutually coaxially aligned along a common longitudinal axis.

The exercising device may further comprise means for determining the rope, cord, webbing or cable position. Said determination of the rope, cord, webbing or cable position in any moment may be performed, for example, by the indirect measurement of the electric motor position. Possible means for measurement of the electric motor position may be by the provision of one or more Hall sensor/s disposed on one or more positions of the electrical motor. Alternatively, an optical or magnetic encoder may also be used to sense the electric motor position. From the electric motor position data, the rotating body position may also be calculated and thus the rope, cord, webbing or cable position.

Alternatively, said determination of the rope, cord, webbing or cable position in any moment may also be performed by the indirect measurement of the rotating body position. In this case, an optical or magnetic encoder may be alternatively used to determine the position of the rotating body. From the rotating body position data, the rope, cord, webbing or cable position may be calculated.

Alternatively, said determination of the rope, cord, webbing or cable position in any moment may also be performed by the direct measurement of the rope, cord, webbing or cable position.

Preferably, a security means, such as Hall sensors or an encoder may be disposed inside the housing of the exercising device for securing that the internal (i.e. proximal) end of the rope, cord, webbing or cable is always at the same place at start/end of the exercise. These security means are configured to detect the position of the rotating body.

The exercising device may further comprise means for measuring the force exerted by the user on the opposed end (i.e. the outer end) of the rope, cord, webbing or cable. A possible embodiment of the means for measuring the force exerted by the user on the opposed end of the rope, cord, webbing or cable may be by measuring the motor current for calculating the force exerted by the user on the opposed end of the rope, cord, webbing or cable.

In reference to the rotating body, it may be configured by a rigid body having a general cylindrical configuration. However, other functional shapes different from a substantially cylindrical configuration may also be used. The rotating body operates as a winding spool configured for receiving a proximal end of at least one rope, cord, webbing or cable wound therearound in a first rotational direction under the specific resistance of the motor. The rotating body rotates in an opposite, second direction when a distal end of the at least one rope, cord, webbing or cable is pulled away from the rotating body with sufficient force to overcome the motor resistance, such as when pulled by the user while performing exercises. In other words, the motor resists the action of the user in such a manner that when the rope, cord, webbing or cable is returning then the motor pulls it back and when the user stretches the rope, cord, webbing or cable, the motor resists with the selected weight or resistance.

In a preferred embodiment, the transmission means outlet is directly connected to the rotating body in such a way as to make the rotating body rotate at the same angular velocity as the transmission means outlet. In an alternative embodiment, the angular velocity of the rotating body and the transmission means outlet may be different, if another type of gear configuration is used.

Optionally, the exercising device further comprises a display disposed in a visible part of the exercising device for enabling a user to visualize one or more types of data related to each exercise performed with the exercising device. The types of data to be visualized on the display (that can be a screen) may be, as an example: the weight or the resistance acquired from the exercising device, the mode of operation (static or dynamic stress) the connection, among other parameters.

In reference to the control unit, it may be integrated at least partially within the enclosure of the exercising device. As a possible embodiment, the control unit may comprise a circuit board or controller circuit. The control unit is electrically connected with at least the means for supplying electrical current to the electric motor and the user interface. The control unit may be programmable allowing it to generate various force vs distance, time or velocity profiles.

In reference to the user interface, for selecting at least a specific input value of the exercise, it may comprise an external interface, being remotely connected to the control unit and wherein the external interface is configured for receiving the desired input value or values of the exercise from the user and transmitting said data to the control unit. The external interface may be, for example, a smart phone, a computer or any other electronic device. In this possible embodiment, the exercising device is remotely controlled and/or programmed by an app of a smart phone or by an interface of a computer, a web interface or any other electronic device.

In some embodiments the control unit includes a wireless transceiver to communicate with the external interface through the use of commonly used wireless protocols, such as BLUETOOTH®, WIFI®, or the like. Therefore, the control unit is also configured for transmitting the output data from the exercise to the external interface, so that the user may monitor, record or share his performance. So the exercising device can communicate bidirectionally with an external computer, smart phones and/or any other electronic device for setup and to track the user's training performance. Furthermore, in a possible embodiment of the invention, either the control unit and/or the external device may store a plurality of user customizable exercises to be selected by the user to improve the training or rehabilitation output and outcome. The combination of the control unit and the external interface permits to have a very precise and flexible control of the exercises and tracking of the performance.

The invention can also operate without having an external control or application, but only an internal input interface. Thus, alternatively or additionally to the external interface, the user interface may comprise an input interface located in an external part of the exercising device, and wherein the input interface is configured so as the user's finger/s may manually operate it for choosing the desired input value or values of the exercise. Said input interface is preferably a tactile interface. The tactile sensor may comprise a tactile sensor, for example a capacitive or a resistive sensor. Each position of the tactile sensor corresponds to a specific value of weight or resistance. This tactile sensor can also include a visual indication element (such as LEDs) for each position. The visual indication of each position on the sensor facilitates the user to select the desired value.

In a possible embodiment of the user interface wherein both an external interface and a tactile user interface is included, the external interface is remotely connected to the control unit and the tactile user interface is also connected to the control unit, and wherein the external interface and/or the tactile user interface is/are configured for sending at least an input value of the exercise to the control unit.

Preferably, at least an input value of the exercise introduced at the user interface may comprise one or a combination of the following parameters: a desired weight value and/or a desired resistance value and/or a desired velocity value of the exercise. Any other data of the exercising device may also be included as an input value of the exercise. As such, to perform the exercises, with the enclosure fixed at the support to existing exercise equipment or a support, the user sets for example a desired cable unwind resistance with the user interface and then pulls the rope, cord, webbing or cable to unwind the rope, cord, webbing or cable from the rotating body. The electric motor thereafter rewinds the rope, cord, webbing or cable onto the rotating body when the user releases the tension of the rope, cord, webbing or cable. The user then pulls the rope, cord, webbing or cable again to repeat the process.

Preferably, the exercising device may further comprise a support or attachment mechanism configured to be fixed on a fixed part of the outer enclosure of the exercising device and wherein the support is configured for fixing the exercising device on different training equipment or supports. In a possible embodiment, the support may be constituted by a "U-shaped" body, wherein the ends of the "U" are respectively fixedly mounted on each end of the exercising device. This "U-shaped" configuration body further has a mechanical fixation at the central arm of the "U" with an external plate.

Optionally, the exercising device may further comprise a connection element, being attached at the opposed (distal) end of the rope, cord, webbing or cable, wherein the connection element comprises an attachment point or grip element for coupling different types of accessories to the exercising device. Possible exercise accessories may be, for example, exercise bars, handles, ropes, and other attachments to facilitate the person pulling the at least one rope, cord, webbing or cable and perform different types of exercises. As an example, the following two different type of exercises may be:

Exercise 1: The device is fixedly fastened with its support to a fixed point and the attachment point of the connection element is coupled to a handle and the user grips the handle with his hands. With this configuration, the user uses the device for rowing, which allows him to work on his endurance while closely monitoring and tracking the performance.

Exercise 2: The device is fixedly fastened with its support to a fixed point and the attachment point of the connection element is coupled to a handle and the user grips the handle with his hands. With this configuration, the user uses the device for biceps curls. The resistance for the exercise can be adjusted according to the training capacity and intensity, in order to build strength and endurance.

Optionally, the exercising device may further comprise means for determining the orientation of the exercising device. By way of example, the means for determining the orientation of the exercising device may be a MEMS sensor, accelerometer or a gyroscope.

To better understand what has been set forth above, drawings which schematically depict, only by way of non-limiting example, a practical case of an embodiment of the exercising device object of the present invention is attached.

The drawings are not necessarily to scale. In certain instances, details that are not necessary for an understanding of the embodiments or that render other details difficult to perceive may have been omitted.

DESCRIPTION OF PREFERRED EMBODIMENTS

FIGS. 1 to 10 show different views of a possible embodiment of the exercising device (1) for developing, strengthening and/or rehabilitating the muscles or joints of the body by working against a counterforce, according to the present invention.

Figure 1:
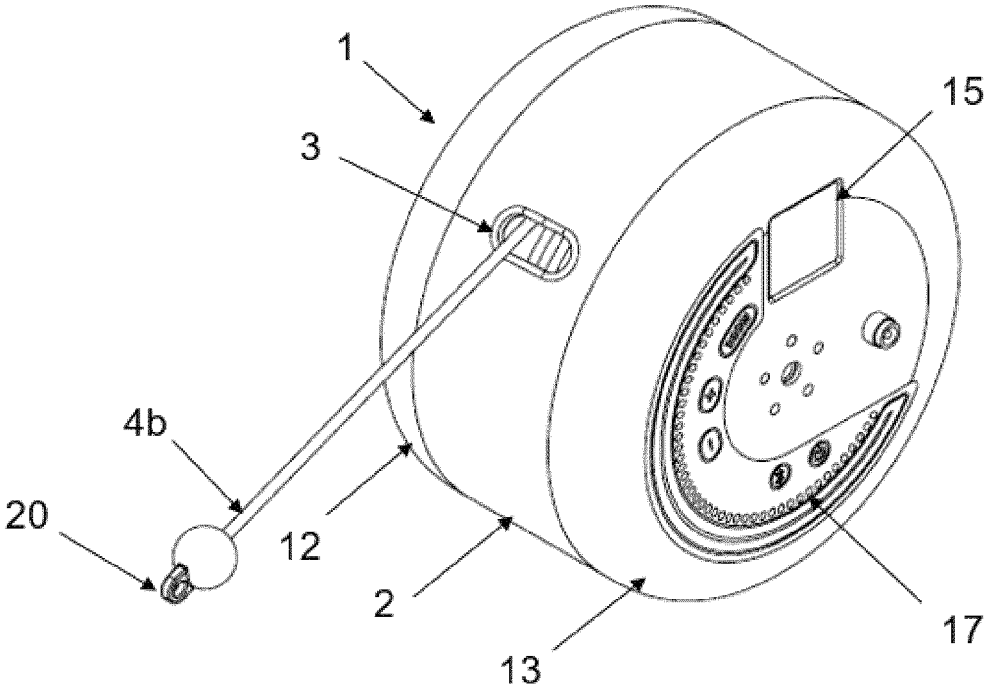
FIG. 1 is a front perspective view of a possible embodiment of the exercising device, according to the present invention.
Figure 2:
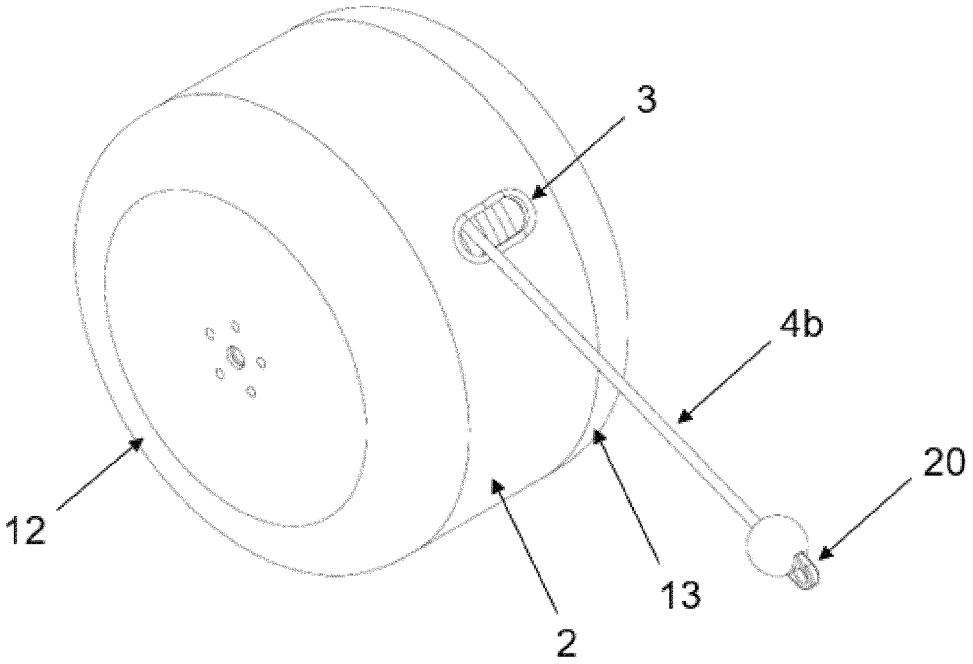
FIG. 2 is a rear perspective view of the same possible embodiment of the exercising device as FIG. 1.
Figure 3:
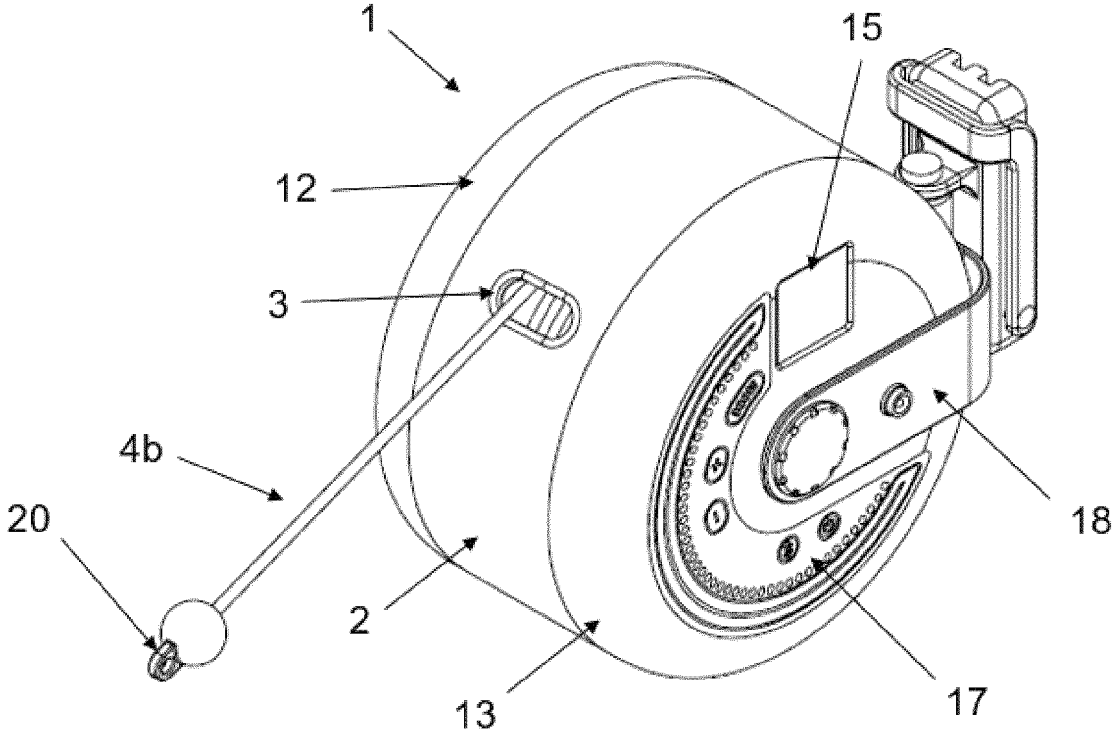
FIG. 3 is a front perspective view of the same possible embodiment of the exercising device as FIGS. 1 y 2 including a possible support.
Figure 4:
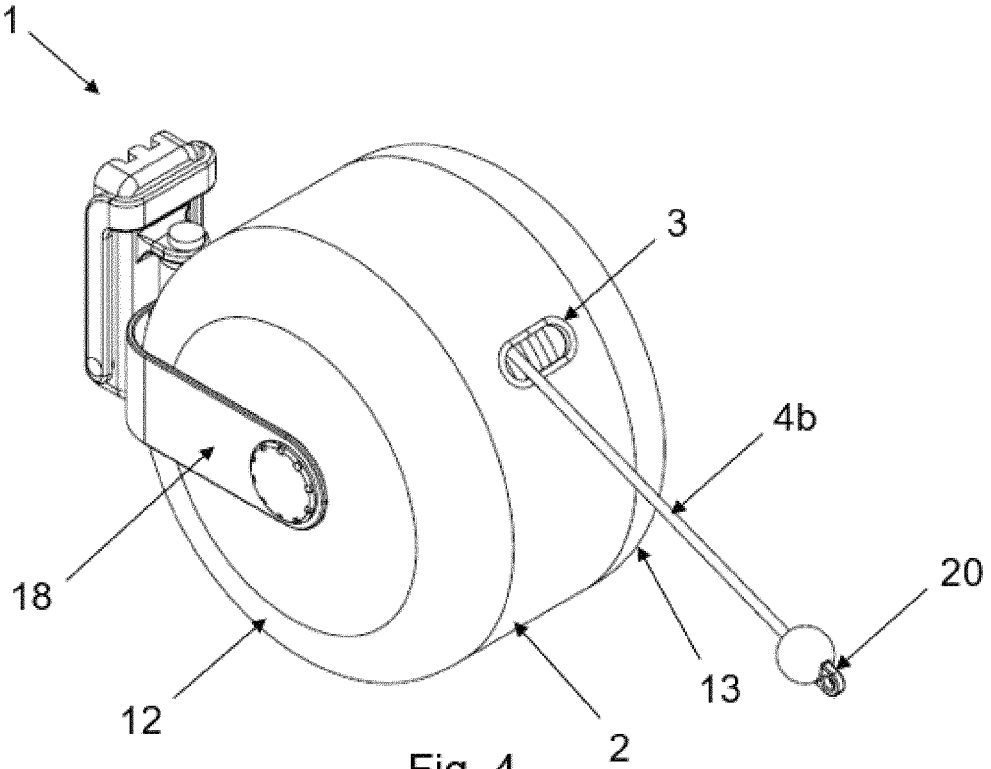
FIG. 4 is a rear perspective view of the same possible embodiment of the exercising device as previous FIGS. 1 to 3 including the possible support.
Figure 5:
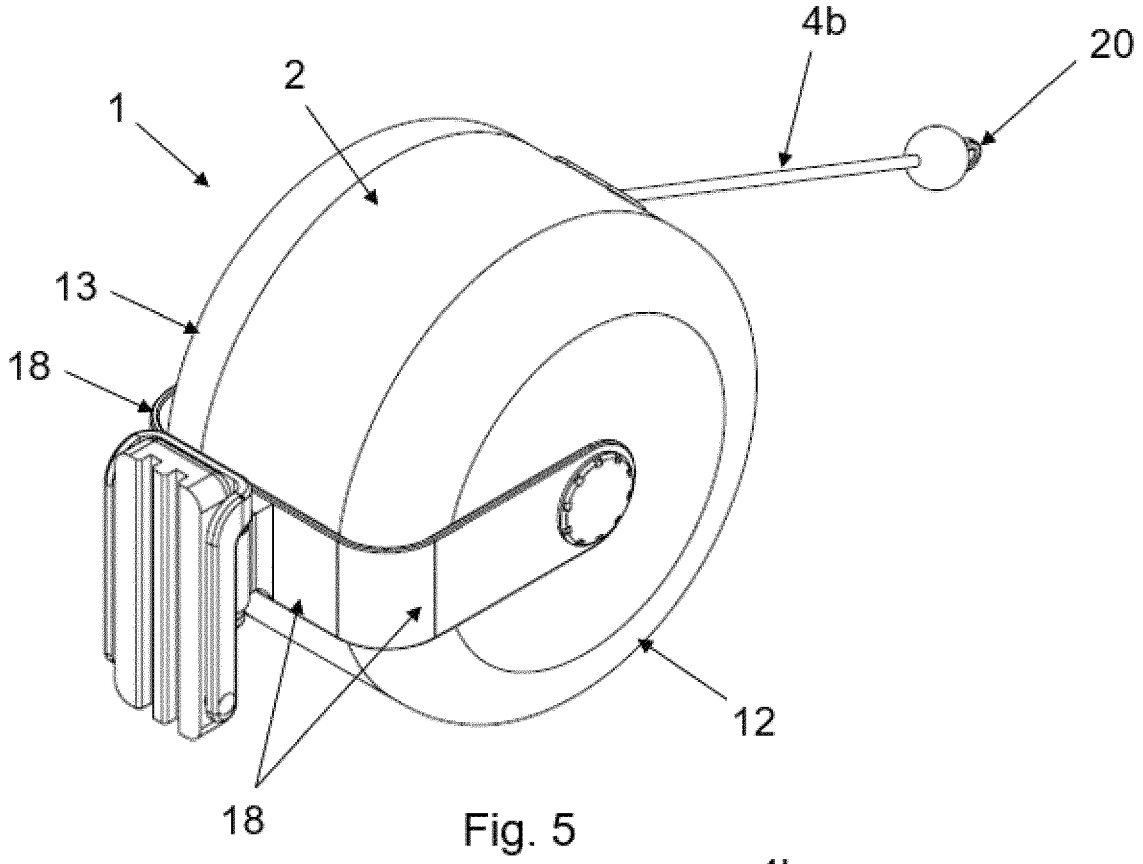
FIG. 5 is another rear perspective view of the same possible embodiment of the exercising device as previous FIGS. 1 to 4 including the possible support.
Figure 6:
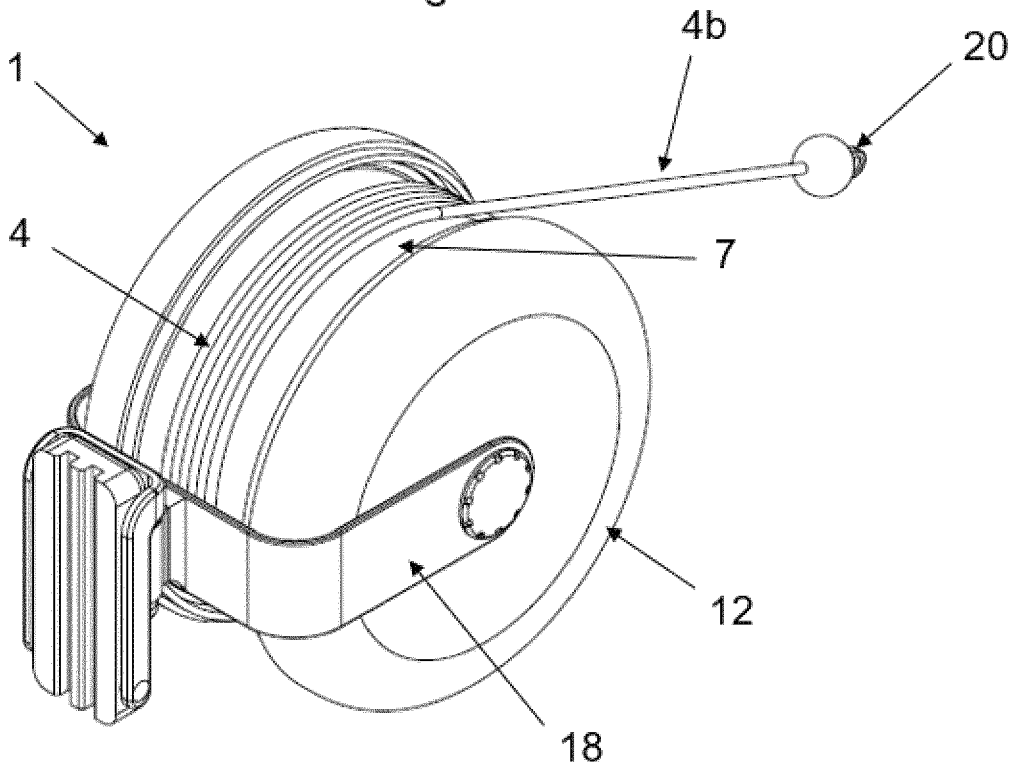
FIG. 6 is the same rear perspective view of the same possible embodiment of the exercising device as previous FIG. 5 but without the protective cover.
Figure 7:
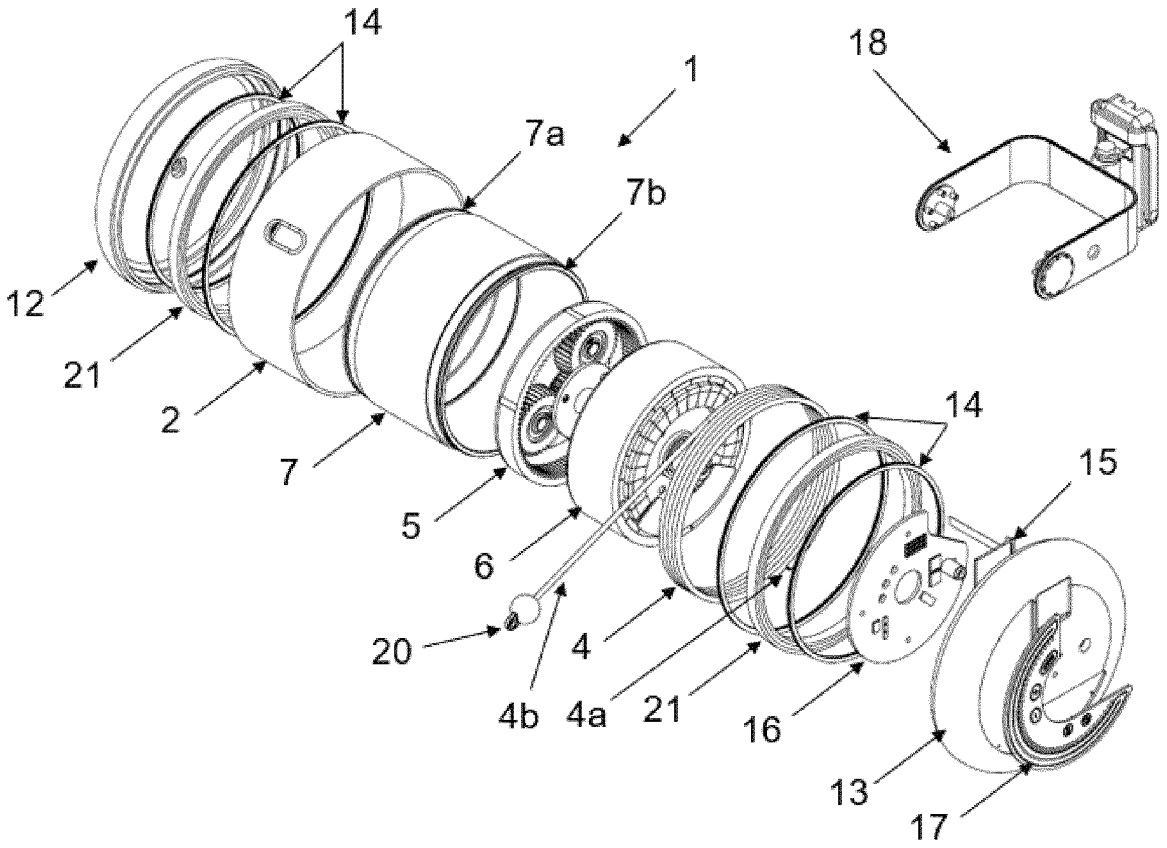
FIG. 7 is an exploded perspective view of the main components of the possible embodiment as previous FIGS. 1 to 8, including the support.

With particular reference to FIG. 7, the main components a possible embodiment of the exercising device (1) of the invention are separately shown. In particular, the exercising device (1) is composed of:

- an outer enclosure, made up of a central protective cover (2), a back cover (12) and a front cover (13), wherein the central protective cover (2) has an opening, path or aperture (3) for the output of the opposed end (4*b*) of the rope, cord, webbing or cable (4) that comes out from interior of the protective cover (2);
- transmission means (5), made up of a planetary gear configuration;
- a rotating body (7), being connected to the transmission means (5) and wherein the rotating body (7) is configured for being turned to retract a rope, cord, webbing or cable (4);
- an electric motor (6), being connected to the transmission means (5) and wherein the electric motor (6) is configured for driving and/or retarding the rotation of the transmission means (5) according to a specific parameter or parameters sent by a control unit (16);

a control unit (16), being connected to the electric motor (6), wherein the control unit (16) is configured for at least commanding the electric motor (6) rotation during the exercise of a specific motion on the basis of at least an input value selected by a user through a tactile user interface (17);

a rope, cord, webbing or cable (4), being directly or indirectly attached at one end (4*a*) to the rotating body (7), and wound around an exterior surface of the rotating body (7) and the opposed end (4*b*) of the rope, cord, webbing or cable (4) is configured for being pulled by the user to exert a desired force; and a tactile user interface (17), for selecting at least a specific input value of the exercise and wherein the user interface is connected to the control unit (16).

The means for supplying electrical current to the electric motor (6) are not represented in the attached figures.

Figure 8:
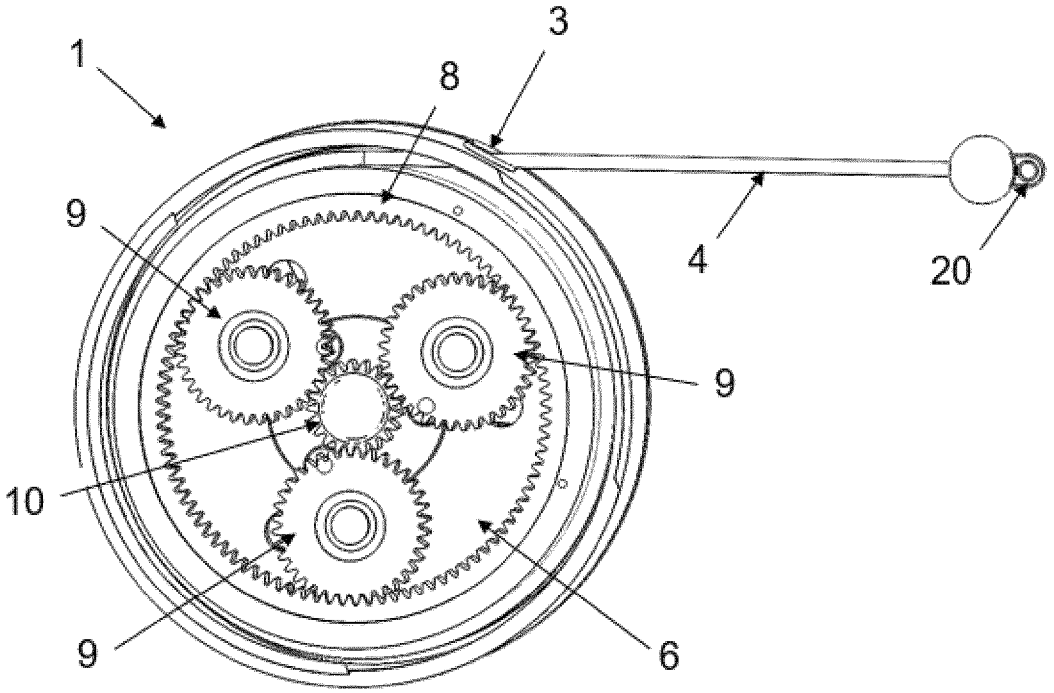
FIG. 8 is a cross-sectional view in the X-Y plane where the transmission means are of the same possible embodiment of the exercising device, so that the transmission means are shown.
Figure 9:
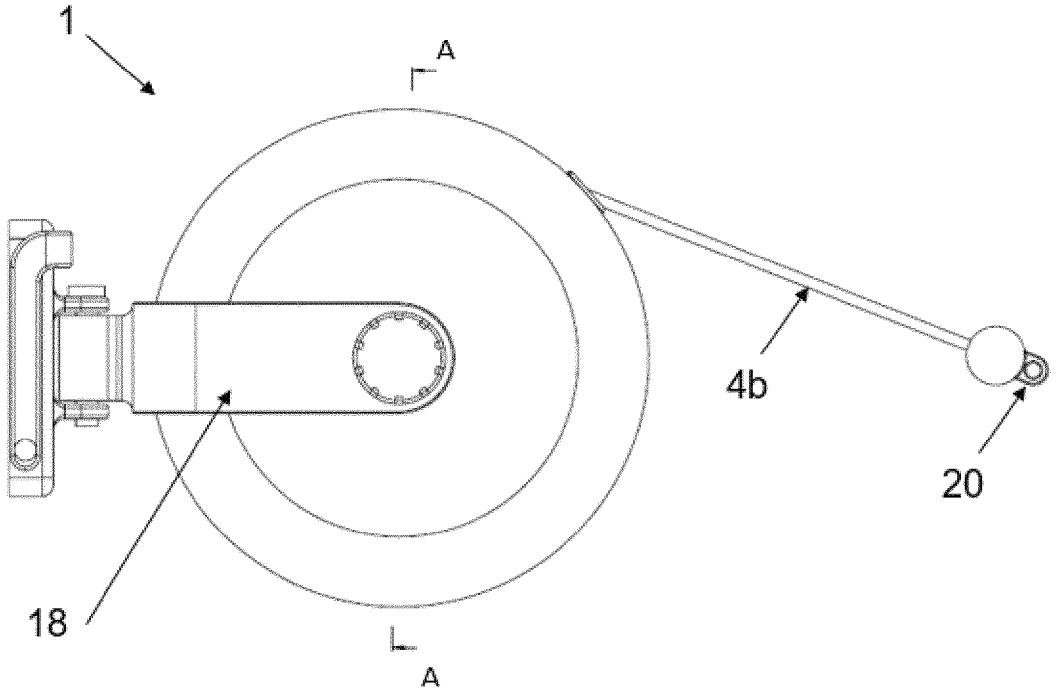
FIG. 9 is a lateral external view of the same possible embodiment of the exercising device as previous FIGS. 1 to 8.
Figure 10:
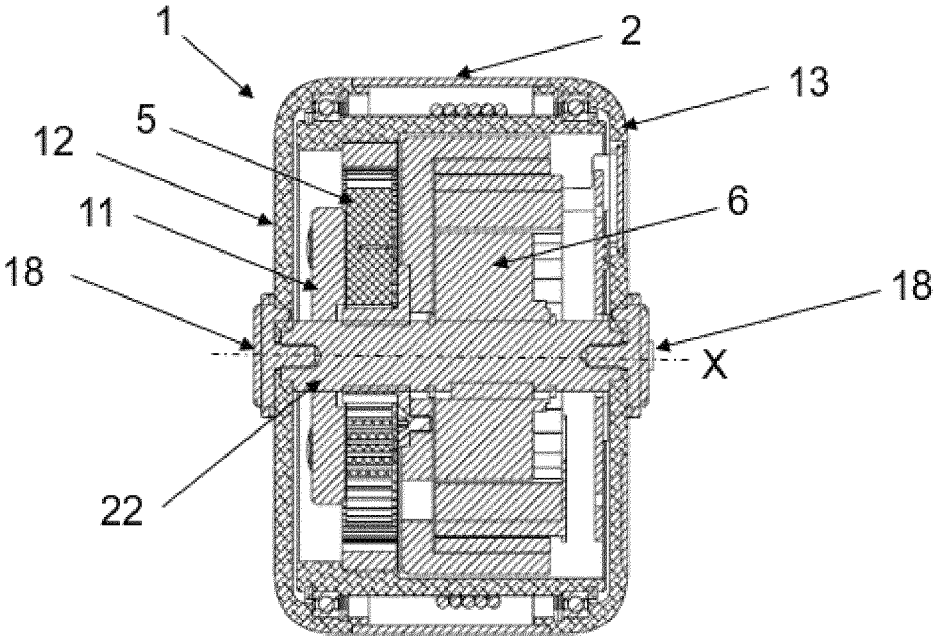
FIG. 10 is a sectional view A-A of the FIG. 9, so that the motor axis is shown.

As it can be seen in FIG. 8, this planetary gear embodiment comprises the following elements:

an outer gear (8), which is integrally connected to the rotating body (7), and which is rotatable induced by the rotation of a planet gears, multiple internal gears (9) that move simultaneously, which are rotatable induced by the movement of a central mobile gear (10), a mobile central gear (10), integrally connected to the electric motor (6) and driven by the electric motor (6), and a fixed planet carrier (11) (not shown in FIG. 8). The fixed planet carrier (11) is shown in FIG. 10.

In this example three internal planetary gears are provided, wherein the three internal planetary gears have the same configuration and dimensions. The planetary gears are also called "planet gears".

In this example, both—the front cover (13) and the back cover (12)—have a circular shaped body with a respective central orifice for receiving the transverse electrical motor axis, see FIG. 7. The central protective cover (2) has a cylindrical body. As it can be seen in FIGS. 1 to 5, the outer enclosure, made up of a central protective cover (2), a back cover (12) and a front cover (13) constitutes a housing that house all the interior elements inside.

As it can be seen in FIG. 7, in this example, the rotating body (7) has a cylindrical body with two end portions (7*a*, 7*b*) having a fitting surface for respectively receive and fit the back cover (12) and a front cover (13) therein, see FIG. 7. In a possible embodiment, a respective bearing (21) is disposed between the fitting surface of the end portions (7*a*, 7*b*) and the back cover (12) or front cover (13). Furthermore, the group formed by the rotating body (7) and the bearings (21) disposed in each end portions (7*a*, 7*b*) is held together by means of one or more snap rings (14) for each back cover (12) or front cover (13). In this example, two snap rings (14) are provided for each back cover (12) or front cover (13). The fitting surface may be, for example, an annular groove for receiving a respective bearing (21) therein.

In this example, the exercising device (1) further includes a display (15) disposed at an external part of the front cover (13).

In this example, the exercising device (1) further includes an U-shaped support (18), which is fixed on a fixed part of both sides of the exercising device (1). More specifically, the arms of the U-shaped support (18) have respective orifices for fixing elements and the arms are disposed respectively on the center of the front cover (13) and on the center of the back cover (12), see FIGS. 3 to 5 and 9. In FIG. 10 the electrical motor axis (22) is represented.

In this example, two snap rings (14) are disposed between each outer covers (12, 13) and the rotating body (7). Also, a bearing ring (21) is disposed between each pair of snap rings (14) of each outer covers (12, 13), see FIG. 7.

In this example, a connection element (20) is attached at the opposed end (4*b*) of the rope, cord, webbing or cable (4). The connection element (20) consist of a ball-shaped body having an attachment ring for coupling different types of accessories to the exercising device (1).

Figure 11:
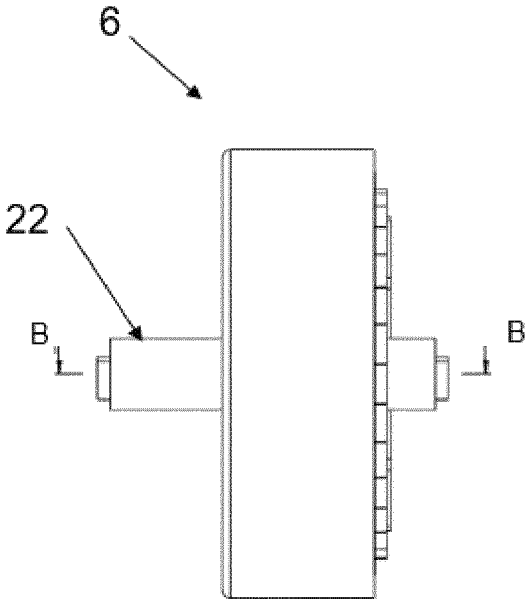
FIG. 11 is a lateral view of a possible embodiment of a motor of the exercising device according to previous FIGS. 1 to 10.
Figure 12:
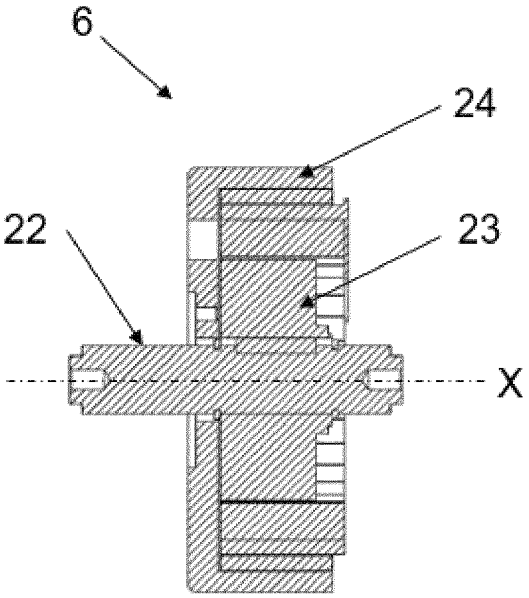
FIG. 12 is a sectional view B-B of the FIG. 11, so that the motor axis is shown.

As it can be seen in FIGS. 11 and 12, a possible embodiment of the electric motor (6) essentially comprises a stator (23), a rotor (24) and transverse motor shaft (22) which is attached to the stator (23), wherein the transverse motor shaft (22) is used for attaching the electric motor (6) in a central position within the outer enclosure of the exercising device (1).

As it can be seen in more detail in FIG. 10, the electric motor (6) is coaxially aligned with the rotating body (7). In particular, the stator (23), the rotor (24), the transverse motor shaft (22) and the rotating body (7) are all mutually coaxially aligned along a common longitudinal axis "X". The transmission means (5) inlet is directly connected to the electric motor (6) outlet, so that the linear or rotary force (torque) is transmitted to the transmission means (5).

Figure 13:
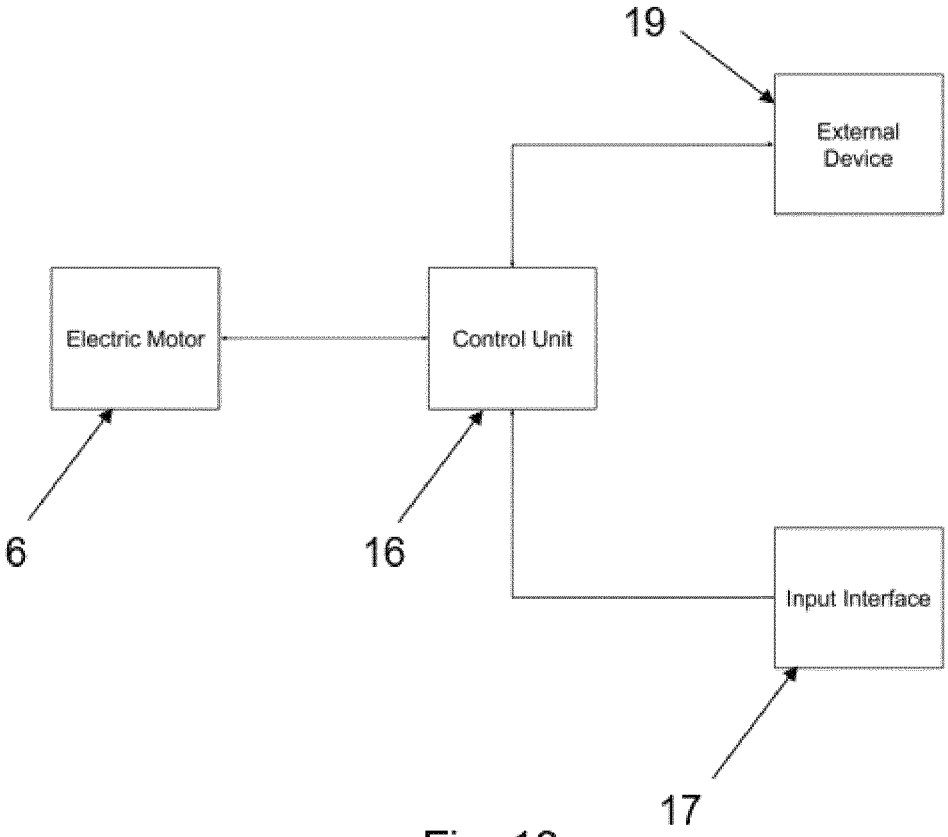
FIG. 13 is a block diagram of some of the functional components of the depicted possible embodiment.

With reference to FIG. 13, a block diagram where the interactions of some of the components of the device are shown. In particular, the electric motor (6) is connected to the control unit (16); and, at the same time, the control unit (16) is also connected to the tactile user interface (17) and/or to the external device (19).

Various modifications to the above invention will become apparent to those skilled in the art, all of which are intended to fall within the scope of the present invention as defined in the appended claims.

The invention claimed is:

1. A portable exercise device for developing, strengthening or rehabilitating a muscle or a joint of a body by working against a counterforce, the device comprising:

a rotating body configured to retract a rope, a cord, a webbing, or a cable;

a transmission means mounted inside the rotating body;

an electric motor connected to the transmission means and configured to drive or retard rotation of the transmission means, wherein the rotating body is located coaxially aligned to and around the electric motor, wherein:

when an end of the rope, the cord, the webbing, or the cable is pulled, the electric motor and the transmission means retard rotation, and when the end returns to the rotating body, the electric motor and the transmission means drive rotation of the rotating body rewinding the end;

a control unit configured to command the electric motor; and a user interface connected to the control unit, wherein the user interface is configured to receive a user input and send a signal to the control unit to control operation of the electric motor during the exercise of a specific motion.

2. The portable exercise device according to claim 1, wherein the transmission means comprises a fixed planet carrier.

3. The portable exercise device according to claim 2, wherein the fixed planet carrier includes a plurality of planetary gears.

4. The portable exercise device according to claim 3, wherein the plurality of planetary gears comprise three planetary gears.

5. The portable exercise device according to claim 4, wherein each of the three planetary gears have a same configuration or dimensions.

6. The portable exercise device according to claim 2, wherein the fixed planet carrier comprises a plurality of gears, including a mobile central gear and multiple internal gears that move simultaneously with the mobile central gear and are rotatably induced by movement of the mobile central gear.

7. The portable exercise device according to claim 6, wherein the mobile central mobile gear connect to the electric motor.

8. The portable exercise device according to claim 1, wherein the rotating body is configured to turn to retract the rope, cord, webbing, or cable.

9. The portable exercise device according to claim 1, further comprising:

a bearing;

a front cover; and a back cover, wherein the rotating body includes an end portion having a fitting surface for receiving and fitting the back cover and front cover, and wherein the bearing is disposed between the fitting surface and the back cover or the front cover.

10. The portable exercise device according to claim 1, further comprising a tactile user interface connected to the control unit and configured to select a specific input value of an exercise.

11. A portable exercising device for developing, strengthening and/or rehabilitating muscles or joints of a body by working against a counterforce, comprising:

a rotating body configured to retract a rope, a cord, a webbing or a cable wound around an exterior surface of the rotating body and having an end configured for being pulled by a user to exert a force;

a transmission means connected to the rotating body;

an electric motor connected to the transmission means and configured to drive or retard rotation of the transmission means, wherein the rotating body is located coaxially aligned to and around the electric motor, wherein:

when the end is pulled, the electric motor and the transmission means retard rotation, when the end returns to the rotating body, the electric motor and the transmission means drive rotation of the rotating body rewinding the end, and the transmission means rotates at a same angular velocity of the rotating body;

a control unit connected to the electric motor and configured to command the electric motor during exercise of a specific motion based on an input value;

a user interface connected to the control unit and configured to receive an input by a user and select an input value of the exercise;

means for supplying electrical current to the electric motor;

an outer enclosure containing at least the transmissions means and the electric motor; and a support fixed on the exercising device and configured for fixing the exercising device on different training equipment or supports, as it is lightweight and compact.

12. The portable exercising device according to claim 11, wherein the user interface comprises an external interface and a tactile user interface, wherein the external interface is remotely connected to the control unit and the tactile user interface is connected to the control unit, and wherein the external interface and/or the tactile user interface is configured for sending at least an input value of the exercise to the control unit.

13. The portable exercising device according to claim 12, wherein the control unit is also configured for transmitting an output data of the exercise to the external interface, so that the user may monitor, record or share his performance.

14. The portable exercising device according to claim 11, wherein the transmission means comprise a gear set configuration that multiplies power output from the electric motor to the rotating body.

15. The portable exercising device according to claim 11, wherein the outer enclosure comprises a protective cover with an opening, a path or an aperture for the end of the rope, the cord, the webbing or the cable to exit out from interior of the outer enclosure through said opening, said path or said aperture.

16. The portable exercising device according to claim 11, further comprising a means for determining a position of the rope, cord, webbing, or cable.

17. The portable exercising device according to claim 1, wherein the exerted force is calculated based on a measured motor current.

18. The portable exercising device according to claim 11, further comprising a display disposed in a visible part of the exercising device for enabling the user to visualize one or more types of data related to each exercise performed with the exercising device.

19. The portable exercising device according to claim 11, wherein the user interface comprises an external interface and is remotely connected to the control unit and wherein the external interface is configured for receiving the user input and transmitting data to the control unit.

20. The portable exercising device according to claim 11, wherein the user interface comprises a tactile user interface located in an external part of the exercising device, and wherein the tactile user interface is configured to be operated manually by the user for choosing at least a desired input value of the exercise.

* * * * *